US007803031B1

(12) United States Patent
Winckler et al.

(10) Patent No.: US 7,803,031 B1
(45) Date of Patent: Sep. 28, 2010

(54) VEHICLE HAVING NON-CIRCULAR WHEELS PROPELLED BY A MOVING WEIGHT

(76) Inventors: Jason M. Winckler, 477 Brunswick Rd., Troy, NY (US) 12180; Steven J. Winckler, 477 Brunswick Rd., Troy, NY (US) 12180

( * ) Notice: Subject to any disclaimer, the term of this patent is extended or adjusted under 35 U.S.C. 154(b) by 644 days.

(21) Appl. No.: 11/591,811

(22) Filed: Nov. 2, 2006

Related U.S. Application Data

(60) Provisional application No. 60/733,320, filed on Nov. 3, 2005.

(51) Int. Cl.
*A63H 17/00* (2006.01)
*A63H 29/00* (2006.01)

(52) U.S. Cl. ..... 446/437; 446/457; 446/465; 446/237

(58) Field of Classification Search ..... 446/3, 446/237, 238, 437, 449, 457, 458, 465; D21/539; 180/24.08, 7.1
See application file for complete search history.

(56) References Cited

U.S. PATENT DOCUMENTS

| | | | | |
|---|---|---|---|---|
| 1,511,928 | A | 10/1924 | Zboril | |
| 2,711,221 | A * | 6/1955 | Kopczynski | 180/24.05 |
| 2,786,540 | A * | 3/1957 | Sfredda | 180/24.08 |
| 2,886,976 | A | 5/1959 | Dean | |
| 3,196,580 | A * | 7/1965 | Rakestraw | 446/484 |
| 3,311,184 | A | 3/1967 | Beck | |
| 3,584,515 | A | 6/1971 | Matyas | |
| 3,782,751 | A * | 1/1974 | Williams | 280/87.01 |
| 4,662,465 | A | 5/1987 | Stewart | |
| 4,817,747 | A * | 4/1989 | Kopczynski | 180/22 |
| 4,834,200 | A | 5/1989 | Kajita | |
| 4,884,465 | A | 12/1989 | Zachystal | |
| 5,088,949 | A * | 2/1992 | Atkinson et al. | 446/3 |
| 5,090,260 | A | 2/1992 | Delroy | |
| 5,361,186 | A | 11/1994 | Tanie et al. | |
| 5,720,644 | A * | 2/1998 | Ku | 446/175 |
| 5,758,734 | A | 6/1998 | Hong et al. | |
| 5,881,831 | A * | 3/1999 | Harvey | 180/6.2 |
| 6,308,791 | B1 | 10/2001 | Spletzer et al. | |
| 2002/0179342 | A1 * | 12/2002 | Quinn et al. | 180/8.1 |

* cited by examiner

*Primary Examiner*—Gene Kim
*Assistant Examiner*—Alyssa M Hylinski
(74) *Attorney, Agent, or Firm*—Malcolm J. Chisholm, Jr.

(57) ABSTRACT

The vehicle (10) includes a frame (12) having at least three non-circular wheels (20, 22, 24) secured to a frame (12), wherein the wheels are mechanically secured to each other so that whenever one non-circular wheel moves, the other wheels (20, 22, 24) move. An offset arm (76) powered by a motor (78) rotates a weight (84) around a geometric center adjacent the wheels to sequentially tip them so that their sequential tipping moves the vehicle (10). The non-circular wheels (20, 22, 24) are sequentially aligned with respect to each other so that whenever one wheel is tipped from a collapse alignment (32) into a contact alignment (34), sequentially the next non-circular wheel (20, 22, 24) is moved into a collapse alignment (32). Any driving force may be used to sequentially tip the non-circular wheels (20, 22, 24, 26), instead of the rotating weight (84).

14 Claims, 3 Drawing Sheets

VEHICLE HAVING NON-CIRCULAR WHEELS PROPELLED BY A MOVING WEIGHT

CROSS REFERENCE TO RELATED APPLICATION

This Application claims the benefit of U.S. Provisional Patent Application Ser. No. 60/733,320 that was filed on Nov. 3, 2005, entitled "Vehicle Having A Non-Circular Wheels Propelled By A Moving Weight".

TECHNICAL FIELD

The present invention relates to vehicles and apparatus that move along the ground or a support surface without directly powered wheels, and more particularly relates to a vehicle that propels itself along a support surface by a moving weight or force.

BACKGROUND ART

Many efforts are known to produce a vehicle that travels along a support surface such as the ground without applying a rotational force upon wheels of the vehicle in contact with the ground. Such vehicles are sought for a variety of purposes, including the simple novelty, or toy-like entertainment value of an innovative or unusual vehicle, as well as a desire for possibly robotic vehicles to travel over uneven terrain that circular wheels cannot ordinarily traverse, for such things as remote exploration or land mine detecting, as well as for micro machines that cannot be manufactured with the usual complexity of their macroscopic counterparts, etc. For example, a gyrostat propulsion system is disclosed in U.S. Pat. No. 5,090,260 to Delroy, and includes rotational spin of two gyrostats secured within a frame to produce precessional forces upon the frame to thereby move the frame. Delroy, however, is extraordinarily complex, and therefore too costly to achieve any valuable function.

Additional attempts to directly convert the traditional rotational force of motors to linear motion are shown in U.S. Pat. No. 4,884,465 to Zachystal which uses a spinning weight that rotates within a frame that supports opposed, extending legs. Similarly, a "walking vehicle" is shown in U.S. Pat. No. 4,662,465 to Stewart, wherein use of rotation between two separate, but linked bodies is utilized with alternate lifting of the bodies through overlapping pairs of flexible legs that support the approximately co-axial bodies in order to move the vehicle over uneven terrain. A much older effort is disclosed in U.S. Pat. No. 2,886,976 to Dean, that shows use of opposed, eccentric rotating weights to generate a controlled linear motion. More recently, U.S. Pat. No. 4,834,200 to Kajita shows use of shifting a center of gravity to produce movement of a pair of legs that support an erect body, much like a human-like robot, in an effort to move the robot over steps, and similar uneven terrain.

All of these and other known efforts to produce a vehicle that propels itself without a rotational force applied directly to circular wheels, or directly to drive wheels such as in tracked vehicles, involve extraordinarily complex apparatus that would be very costly to manufacture. Perhaps more importantly, known efforts have not been successful at engaging rough terrain and have not produced an efficient use of the rotational force, compared to traditional, circular wheeled vehicles. Accordingly, there is a need for a vehicle that can propel itself by way of an efficient use of force that is not mechanically linked to rotation of circular wheels supporting and moving the vehicle.

SUMMARY OF THE INVENTION

The invention is a vehicle having non-circular wheels propelled by a moving weight or force. Essentially, the vehicle includes a frame having three or more non-circular wheels at a periphery of the vehicle, wherein the wheels are mechanically secured to each other so that whenever one non-circular wheel moves, the other wheels move. An offset arm powered by a motor moves a weight around a weight circumference defined around an approximate geometric center between the non-circular wheels to sequentially tip them so that their sequential tipping moves the vehicle in a direction of travel of the vehicle.

More specifically, the vehicle includes a frame having a first axle and a second axle secured to the frame and having a linkage such as a chain or belt secured between the two axles for rotating the first axle upon rotation of the second axle and for rotation of the second axle upon rotation of the first axle. A first non-circular wheel and a second non-circular wheel are firmly secured to opposed ends of the first axle, and at least a third non-circular wheel is firmly secured to the second axle, and typically a fourth non-circular wheel is secured to an opposed end of the second axle. Each non-circular wheel includes a perimeter having at least three contact segments for contacting a support surface under and supporting the vehicle. In some embodiments, the non-circular wheels may have two contact segments, such as a high aspect ratio rectangle. By the phrase "firmly secured", it is meant that rotation of one non-circular wheel, such as the first, causes rotation of the second non-circular wheel, and through the linkage, also causes rotation of the second axle and its firmly secured third and any fourth non-circular wheels.

The non-circular wheels are secured to the axles in a specific sequential alignment. The sequential alignment means that whenever a first contact segment of the first non-circular wheel is secured to the first axle in a contact alignment to contact the support surface below the vehicle, a first contact segment of the second non-circular wheel is secured to the opposed end of the first axle in a collapse alignment. By "collapse alignment", it is meant that motion of the vehicle in a direction of travel will move the second non-circular wheel from the collapse alignment immediately into the contact alignment. Additionally, whenever the first contact segment of the second non-circular wheel is in a contact alignment, a first contact segment of the third non-circular wheel is secured to the second axle in the collapse alignment. If the vehicle includes four non-circular wheels, then whenever the first contact segment of the third wheel is aligned in a contact alignment, the first contact segment of the fourth non-circular wheel would be aligned in a collapse alignment. The sequential alignment of the non-circular wheels includes the described sequence of all of the wheels being in either a clockwise or a counter clockwise orientation.

An offset arm is movably secured to a motor that is secured to the frame for moving the offset arm. The offset arm includes a weight support end and an opposed motor attachment end. The motor attachment end is movably secured to the motor for moving the arm such as by a rotational motion. The offset arm is dimensioned so that movement of the motor attachment end by the motor moves the weight support end about a weight-circumference defined by movement of the weight support end. The weight-circumference circles around an approximate geometric center between the non-circular wheels. A weight is supported by the weight support end of the offset arm, and the weight is sufficiently heavy and the weight support end of the offset arm is a sufficient distance from the geometric center between the wheels so that as the motor moves the weight support end of the arm along the weight-circumference through the sequential alignment of the non-circular wheels, gravity forces a non-circular wheel in the collapse alignment under the weight to collapse to the contact alignment. The axle or the linkage means then moves the next sequential non-circular wheel to the collapse alignment to be collapsed to the contact alignment as the weight moves through the weight-circumference. Therefore, the motion, such as a rotational motion of the offset arm, effectively causes the non-circular wheels to sequentially rotate from the collapse to the contact alignment, and then to another alignment, then back to the collapse alignment and again to the contact alignment. This sequential movement of the non-circular wheels thereby moves the vehicle in the direction of travel. The heavier the weight, the shorter the offset arm may be to achieve the described, sequential movement of the non-circular wheels, within reasonable limits of weight and length that may be readily measured by one skilled in the art.

In a preferred embodiment, the vehicle includes four non-circular wheels, and each non-circular wheel defines four sides, such as a square. In such an embodiment, whenever a first segment of the non-circular wheel is in the collapse alignment, an angle between the first segment and the contact surface would be approximately 22.5 degrees ("22.5°"). Alternatively, the four non-circular wheels may define three sides, such as an equilateral triangle, the angle between a first segment of such a wheel in the collapse alignment and the support surface would be about 30°. Additionally, the non-circular wheels may define five, six or more sides, wherein the more sides, the smoother the movement of the vehicle, but the closer a non-circular wheel is to defining a circular shape about the axle, the greater a loss of propelling potential.

In a further preferred embodiment, each non-circular wheel on the vehicle defines the same number of segments, and each wheel also defines the same angle between segments of each wheel. Because the angle between the segments is the same, the vehicle may readily travel in a forward or rearward direction of travel based upon whether the offset arm is moving in a clockwise or a counter clockwise direction.

Because the non-circular wheels are firmly secured through mechanical linkage and/or the axles, in certain embodiments steering the vehicle requires a non-traditional steering mechanism. In other embodiments, conventional steering may be utilized, especially where the vehicle is moving slowly and one of the non-circular wheels tends to lift as the wheels turn, minimizing any problems with a wheel dragging while turning with a conventional steering mechanism. In a certain embodiment, the vehicle may be steered by articulation of the frame about a center or pivot point. In another embodiment, steering may be achieved by having wheels on one side be or become greater in size. Additionally, steering may be achieved by a rotating plate that descends at predetermined intervals to the support surface to lift and rotate the frame to a desired orientation. Additionally, if the wheels were rotated about a vertical axis (like a conventional steering mechanism), and aligned so that they all tended to move around a circle, the car would rotate or turn about a vertical axis as the weight (force) was moved, thus changing the direction of the car. In such circumstances, whether the sequential alignment of the non-circular wheels is oriented to be clockwise or counter clockwise would determine whether the vehicle would turn in the same direction as the rotation of the force (or weight) or counter to that direction.

In yet another embodiment, the non-circular wheels may be in the form of spokes without a rim or may be in the form of star-shaped rods having no material between non-central end-points of the rods, wherein the end-points of the rods define vertices on a perimeter of a polygon. This would further facilitate movement over uneven terrain. The end-points may also be covered with support pads or they may form rounded tips, and the tips may also be of resilient material to further cushion movement of the vehicle.

The non-circular wheels discussed so far are generally polygons, having straight line segments joined about the wheel perimeter, where a contact angle of sequential line segments changes abruptly from one segment to the next segment. The non-circular wheels thus have discrete (discontinuous) changes in contact angles around the perimeter, from segment to segment. Just as The Calculus moves from the Riemann Sum to the definite integral (rough discontinuous functions to smooth continuous functions), so the contact angle of the non-circular wheel perimeter can change continuously, without discontinuity around the perimeter. Such non-circular wheel shapes therefore also include: non-circular wheels having smooth perimeters, such as an elliptical shape, or a round or circular perimeter with an axle of the wheel offset from a center of a circle, as discussed below; smooth contours connected at sharp points, such as a bi-convex wheel; straight segments connected at curved points, such as a square with round corners; combinations of smooth and abrupt contact angles; and, combinations thereof.

An exemplary and valuable embodiment of a different type of non-circular shape includes a vehicle that may be in the form of a vehicle having what is referred to herein as non-circular rotational perimeter wheels propelled by a moving weight or force. In this embodiment, the same principles described above utilize gravity of the rotating weight or other forces described herein to propel the vehicle along a direction of travel, using the described mechanical linkage of the wheels to each other (such as through the axles), the sequential alignment of the wheels, and the offset arm rotating a weight about the weight-circumference. However, each non-circular rotational perimeter wheel of this embodiment is secured to the axle in an essentially eccentric manner so that a point on the perimeter of a non-circular rotational wheel is a first distance from the axle, and an adjacent point is a distance from the axle that is different than the first distance.

Additionally, each non-circular rotational perimeter wheel includes a first contact segment that may consist of between about fifteen degrees and about forty-five degrees of the perimeter of the wheel (wherein each perimeter consists of three-hundred and sixty degrees about the axle) that is closest to the axle, and a second contact segment adjacent to the first contact segment, the second contact segment consisting of about at least fifteen degrees of the perimeter next to the first contact segment. The sequential alignment of the non-circular rotational perimeter wheel embodiment is the same as described above for the other embodiments. In other words, whenever a first contact segment of a first non-circular rotational perimeter wheel is secured to the first axle in the above described contact alignment to contact the support surface below the vehicle, a first contact segment of a second non-circular rotational perimeter wheel is secured to the opposed end of the first axle in a collapse alignment. Additionally, whenever the first contact segment of the second non-circular rotational perimeter wheel is in a contact alignment, a first contact segment of a third non-circular rotational perimeter wheel is secured to the second axle in the collapse alignment. As the vehicle of this embodiment proceeds along the direction of travel, like the other embodiments, the resulting vehicle motion produces a wobble-like effect because the perimeters of the wheels define non-circular rotation. The perimeters of the non-circular rotational perimeter wheels may be round, oval, egg-shaped, etc., provided they conform to the definitions above.

The invention also includes a method of propelling a vehicle, including the steps of securing three or more non-circular wheels or non-circular rotational perimeter wheels to a periphery of a frame of the vehicle, wherein the wheels are secured in the described alignment so that whenever a contact segment of the first non-circular wheel is in the contact alignment, a first contact segment of a second non-circular wheel is secured in the collapse alignment, then rotating an offset arm secured to a motor on the frame so that a weight supported by a weight end of the arm defines a weight-circumference around a geometric center between the wheels to sequentially tip the wheels from collapse alignments to contact alignments, thereby moving the vehicle in a direction of travel.

Accordingly, it is a general purpose of the present invention to provide a vehicle having non-circular wheels propelled by a moving weight that overcomes deficiencies of the prior art.

It is a more specific purpose to provide a vehicle having non-circular wheels propelled by a moving weight that readily moves over uneven terrain and that also minimizes manufacturing and operating costs of the vehicle.

These and other purposes and advantages of the present vehicle having non-circular wheels propelled by a moving weight will become more readily apparent when the following description is read in conjunction with the accompanying drawing.

DESCRIPTION OF THE PREFERRED EMBODIMENTS

Figure 1:
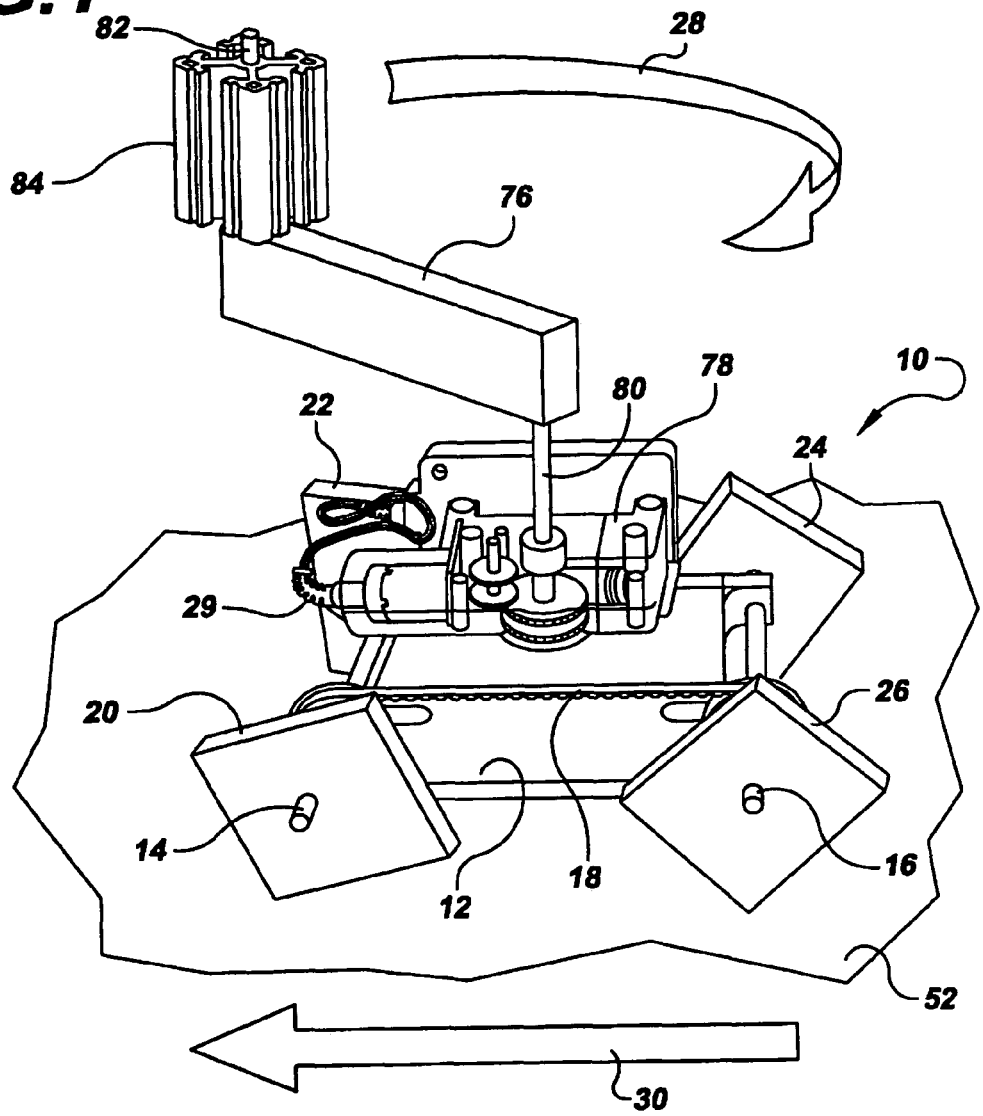
FIG. 1 is a raised perspective view of a vehicle having non-circular wheels propelled by a moving weight constructed in accordance with the present invention.

Referring to the drawings in detail, a vehicle having non-circular wheels is shown in FIG. 1, and is generally designated by the reference numeral 10. The vehicle 10 includes a frame 12 having a first axle 14 and a second axle 16, and a linkage means secured between the first and second axles 14, 16 for rotating the first axle 14 upon rotation of the second axle 16 and for rotation of the second axle 16 upon rotation of the first axle 14, such as a gear belt, chain, or any known mechanical connection 18 extending between the axles 14, 16. Additionally, the linkage means may include direct mechanical, hydraulic, electric, or any known linkage means capable of rotating all non-circular wheels upon the rotation of one of the non-circular wheels, wherein the linkage means 18 replaces the first and second axles 14, 16.

Figure 2:
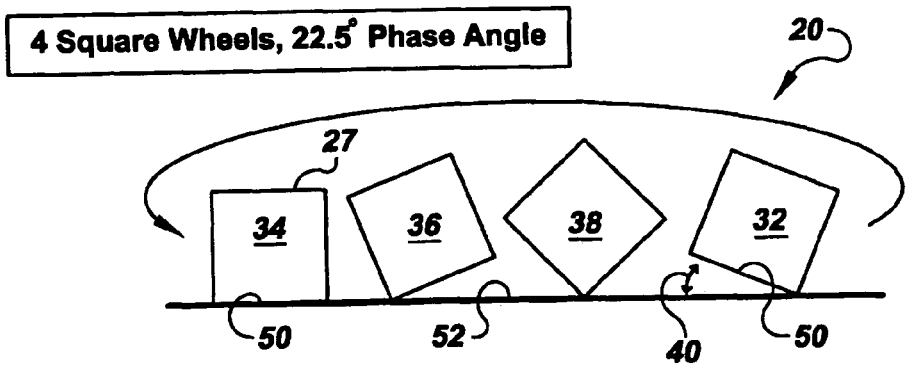
FIG. 2 is a simplified schematic view of a four-sided, square non-circular wheel showing the wheel in four alignments.

A first non-circular wheel 20 and a second non-circular wheel 22 are firmly secured to opposed ends of the first axle 14, and a third non-circular wheel 24 and a fourth non-circular wheel 26 are firmly secured to opposed ends of the second axle 16. As best shown in FIG. 2, each non-circular wheel 20 includes a perimeter 27 having four contact segments for contacting a support surface.

The non-circular wheels 20, 22, 24, 26 are secured to the frame 12 in a specific, sequential alignment. In FIG. 1, the non-circular wheels are shown so that the second non-circular wheel 22 is shown in a contact alignment so that a first contact segment 29 of the wheel 22 is in contact with the support surface 52. If the axis of a view orientation, as shown in FIG. 1, is from above the support surface 52 down onto the vehicle, 10, then the sequential alignment is clockwise as indicated by the off-set arm rotation direction arrow 28, so that sequentially, the next non-circular wheel, the third non-circular wheel 24 is in a collapse alignment, so that motion of the vehicle in a direction of travel, as indicated by the direction of travel arrow 30 would move the wheel in the collapse alignment immediately into the contact alignment. Sequentially, the next non-circular wheel is the fourth non-circular wheel 26, which is secured sequentially so that whenever the preceding, or third non-circular wheel is in a collapse alignment, the sequentially following fourth non-circular wheel is secured in a first non-contact, non-collapse alignment. Sequentially in the direction of rotation 28, the next non-circular wheel, is the first non-circular wheel 20, which is secured so that whenever the sequentially preceding wheel is secured in the first non-contact, non-collapse alignment, the first non-circular wheel is secured in a second non-contact, non-collapse alignment. By this sequential alignment, whenever one of the non-circular wheels collapses from a collapse alignment to a contact alignment, sequentially the next non-circular wheel moves from a non-contact, non-collapse alignment into a collapse alignment.

In FIG. 2, the first non-circular wheel 20 is shown in the above described four alignments, that progress from the collapse alignment, as shown by reference numeral 32, to the contact alignment 34, to the first non-contact, non-collapse alignment 36, the second non-contact, non-collapse alignment 38, and then back to the collapse alignment 32, as the vehicle 10 moves in the direction of travel 30. FIG. 2 also shows a collapse, or phase angle 40 for a four-sided non-circular wheel as being 22.5° where the vehicle includes four such four-sided wheels. When the non-circular wheel 20 is in the contact alignment represented by reference numeral 34, a first contact segment 50 of the first non-circular wheel is in a contact alignment to contact the support surface 52 that supports the vehicle 10. When the first non-circular wheel 20 is secured in the collapse alignment 32, the first contact segment 50 is in the collapse alignment 32.

Figure 3:
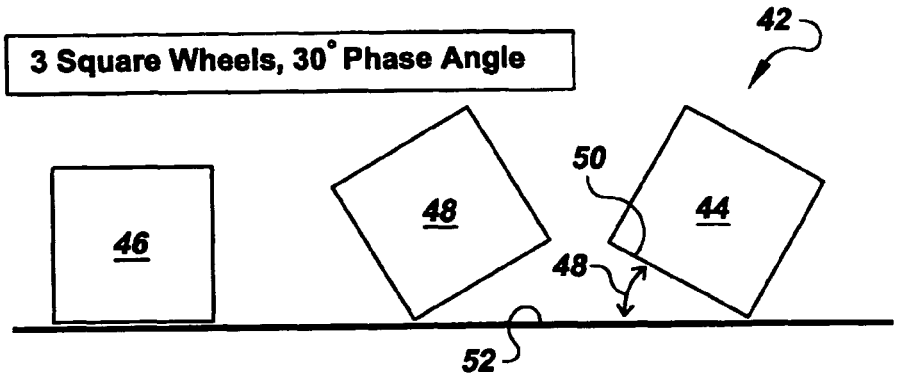
FIG. 3 is a simplified schematic view of a four-sided, non-circular wheel showing the wheel in three alignments.
Figure 4:
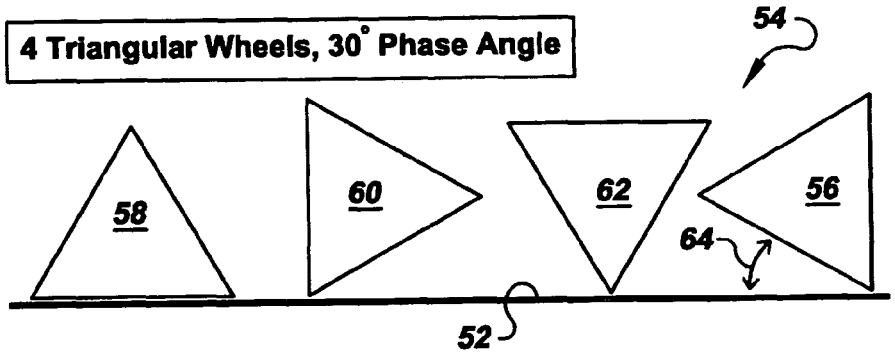
FIG. 4 is a simplified schematic view of a three-sided, non-circular wheel showing the wheel in four alignments.
Figure 5:
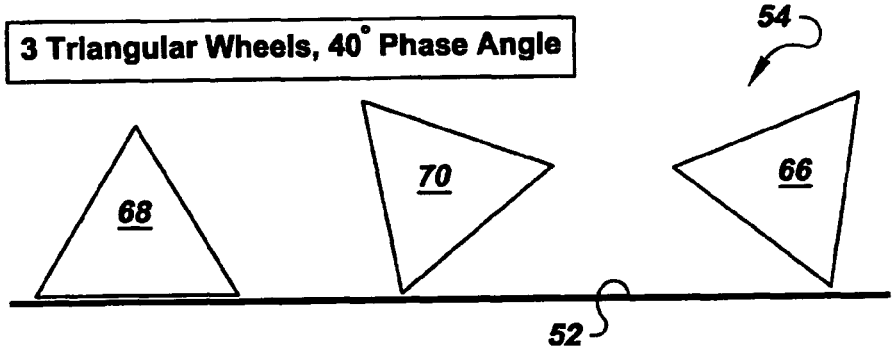
FIG. 5 is a simplified schematic view of a three-sided, non-circular wheel showing the wheel in three alignments.

FIG. 3 shows alignments for a four-sided non-circular wheel 42 wherein only three such wheels are used. Reference numeral 44 shows such a wheel in a collapse alignment, while number 46 shows the wheel 42 in a contact alignment, and numeral 48 shows the wheel 42 in a first non-contact, non-collapse alignment. In such an embodiment of the vehicle 10, in the collapse alignment 44, the collapse or phase angle 48 between the first contact segment 50 and a support surface 52 is 30°. FIG. 4 shows a three-sided non-circular wheel 54 wherein four such wheels would be used on the vehicle. First, the wheel 54 is shown in a collapse alignment 56, then in a contact alignment 58, and next in first and second non-contact, non-collapse alignments 60, 62. In such an embodiment, the collapse or phase angle between the wheel 54 in the collapse alignment 56 and the support surface would be 30°. Similarly, FIG. 5 shows the three sided non-circular wheel 54 wherein just three of such wheels 54 would be used on the vehicle. First the wheel 54 is shown in a collapse alignment 66, then a contact alignment 68, and finally in a first non-contact, non-collapse alignment 70. In such an embodiment, the collapse or phase angle between the wheel 54 in the collapse alignment 66 would be 40°.

Figure 6:
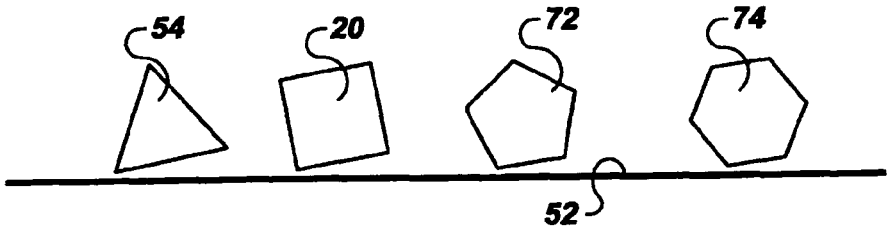
FIG. 6 is a simplified schematic view of varying non-circular wheels in a collapse alignment.

FIG. 6 shows the three-sided, non-circular wheel 54, the four-sided, non-circular wheel 20, a five-sided, non-circular wheel 72 and a six-sided non-circular wheel 74 all deployed in collapse alignments that show the decreasing collapse or phase angles as the number of sides increases. By having a greater number of sides, the non-circular wheels provide a smoother ride for the vehicle 10. The wheels may have rounded corners, or some other non-round shape, like an ellipse (an ellipse is a smoothed two-sided wheel), or a bi-convex shape. For example, four ellipses with a phase angle of 45° would work. There is also a two-sided version that could work, wherein a high aspect ratio rectangle would function as a two-sided wheel. The four wheel version in this case would require a phase angle of 45°. Additionally, a near-circular wheel having two flat spots 180° from each other would also work. In addition, five, six or seven and more wheels could be used where the wheels are placed around the circumference of a circle, for example, where all are linked to rotate in unison, and all rotate along the same rectilinear direction. These multi-wheeled vehicles could use a sequential phase angle between wheels of (360°/Ns/Nw) degrees, where "Ns" is the number of sides per wheel (assuming they are all the same), and "Nw" is the number of wheels. This formula also works for the previous phase angles stated. Pushing this approach to the limit, a near infinite number of small wheels around a large circle can be envisioned. In fact some type of continuous wheel-like entity might be possible, much like integral calculus moves from finite increments to the Riemann Sum and finally to the Integral. Additionally as described above the vehicle may be in the form of an embodiment described below with respect to FIG. 8 having non-circular rotational perimeter wheels. In contrast, and for purposes herein, a "circular wheel" is a wheel wherein all points on the circumference are equidistant from a center of the circular wheel (not shown) to which a rotating axle (not shown) is secured.

The moving force of the gravity of the weight 84 must create a moment on at least one of the non-circular wheels in the sequential alignment that thereby tends to drive the vehicle 10 in a rectilinear motion. The maximum magnitude of the necessary moment decreases as the number of sides increases, wherein a limit is that the wheel may not be a circular wheel so that such a wheel would be circular relative to rotation about the axle 14, 16.

Returning to FIG. 1, the vehicle also includes an offset arm 76 secured to a motor means 78 for rotating or otherwise moving the arm 76. The offset arm includes a motor attachment end 80 movably secured to the motor 78 and an opposed weight support end 82 that supports a weight 84. The offset arm 76 is dimensioned so that movement of the motor attachment end 80 by the motor 78 moves the weight support end 82 about a weight-circumference defined by movement of the weight support end 82. The weight-circumference circles around an approximate geometric center between the non-circular wheels and passes adjacent the non-circular wheels 20, 22, 24, 26. The weight 84 is sufficiently heavy and the weight support end of the offset arm is a sufficient distance from the geometric center between the wheels so that as the motor 78 moves the weight support end 82 of the arm 76 along the weight-circumference through the sequential alignment adjacent the non-circular wheels 20, 22, 24, 26, gravity forces the third non-circular wheel in the collapse alignment under the weight 84 to collapse to the contact alignment, and the axle 16, 18 or the linkage means moves the next sequential, or fourth non-circular wheel 26 to the collapse alignment 32 to be collapsed to the contact alignment 34 as the weight 84 moves through the weight-circumference. Therefore, the motion, such as a rotational motion of the offset arm 76, effectively causes the respective segments of the non-circular wheels 20, 22, 24, 26, to sequentially rotate from the collapse alignment 32 to the contact alignment 34, and then to non-contact, non-collapse alignments 36, 38, then back to the collapse alignment 32 and again to the contact alignment 34. This sequential movement of the non-circular wheels 20, 22, 24, 25 thereby moves the vehicle 10 in the direction of travel 30.

Figure 7:
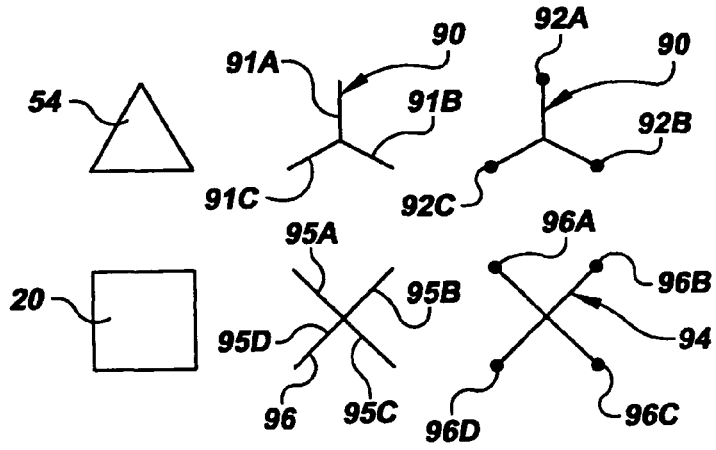
FIG. 7 is a simplified schematic view showing non-circular three and four sided wheels as defining solid sides and defining void sides between rods that define the non-circular wheels.

FIG. 7 shows alternative non-circular wheels, including the three-sided, non-circular wheel 54 first as a three-spoked wheel 90 including a plurality of spokes 91A, 91B, 91C, and then showing the three-spoked wheel 90 with expanded, resilient end caps 92A, 92B, 92C. Additionally, in FIG. 7, the four-sided, non-circular wheel 20 is shown as a four-spoked wheel 94 including a plurality of spokes 95A, 95B, 95C, 95D, and also with expanded resilient end caps 96A, 96B, 96C, 96D, to soften the impact of the wheel 94 upon a support surface.

Figure 8:
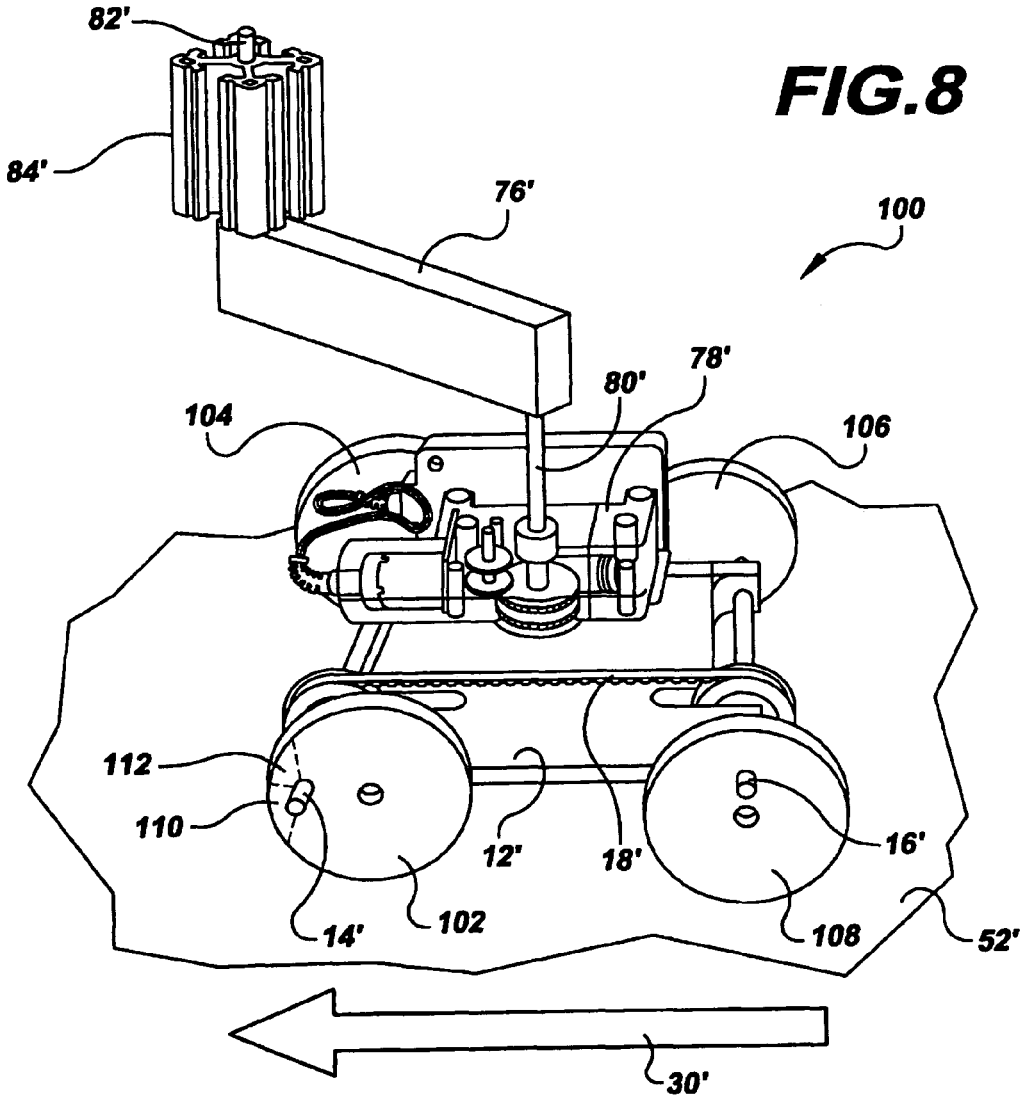
FIG. 8 is a raised perspective view of an alternative embodiment being a vehicle having non-circular rotational perimeter wheels propelled by a moving weight, constructed in accordance with the present invention.

FIG. 8 shows an alternative "round wheel" (not to be confused with a "circular wheel" described above) embodiment of the present invention which is a vehicle 100 having non-circular rotational perimeter wheels propelled by a moving weight. The non-circular rotational perimeter wheels vehicle embodiment 100 includes the same components described above for the FIGS. 1 & 8 embodiment, including for example a frame 12', a first axle 14', a second axle 16', an offset arm 78', etc. (The reference numerals associated with the FIG. 1 embodiment that are the same as the components of the FIG. 8 embodiment are shown as primes of the FIG. 1 embodiment.) What is different about the FIG. 8 embodiment is that it includes at least one, or a first non-circular rotational perimeter wheel 102, and typically a second non-circular rotational perimeter wheel 104, a third non-circular rotational perimeter wheel 106, and most often a fourth non-circular rotational perimeter wheel 108. The non-circular rotational perimeter wheels have circular perimeters, but the wheels are secured to the frame 12', first and/or second axles 14'. 16' so that rotational perimeters about the frame 12', axles 14', 16' to which the wheels 102, 104, 106, 108 are secured are non-circular. Hereinafter, this will be referred to for convenience as the non-circular rotational perimeter wheels 102, 104, 106, 108 being eccentrically secured to the frame 12' or axles 14', 16'. That is because the wheels 102, 104, 106, 108 are secured in an eccentric manner configured so that the first or second axle 14', 16' are not secured to the center of the wheels. In other words, any point on a perimeter of the non-circular rotational wheels 102, 104, 106, 108 that rotates 360 degrees about the first or second axles 14', 16' would define a non-circular pattern.

As with the FIG. 1 embodiment of the vehicle 10, in the FIG. 8 embodiment, the non-circular rotational perimeter wheels 102, 104, 106, 108 are secured in a sequential alignment so that rotation of the weight 82' moves the vehicle 100 in a direction of travel. Each non-circular rotational perimeter wheel 102, 104, 106, 108 includes a first contact segment 110

(shown with respect to first wheel 102) that consists of about at least fifteen degrees of the perimeter of the wheel 102 (wherein each perimeter consists of three-hundred and sixty degrees about the axle) that is closest to the axle 14', and a second contact segment 112 adjacent to the first contact segment, the second contact segment 112 consisting of about at least fifteen degrees of the perimeter next to the first contact segment 110. The sequential alignment of the non-circular rotational perimeter wheel embodiment 100 is the same as described above for the FIG. 1 embodiment 10. In other words, whenever the first contact segment 112 of the first non-circular rotational perimeter wheel 102 is secured to the first axle 14' in a described contact alignment to contact the support surface 52 below the vehicle 100, a first contact segment (not shown) of the second non-circular rotational perimeter wheel 104 is secured to the opposed end of the first axle 14' in a collapse alignment. Additionally, whenever the first contact segment of the second non-circular rotational perimeter wheel 104 is in a contact alignment, a first contact segment (not shown) of the third non-circular rotational perimeter wheel 106 is secured to the second axle 16' in the collapse alignment.

As the vehicle 100 of this FIG. 8 embodiment proceeds along a direction of travel, like the FIG. 1 embodiment, the resulting vehicle motion produces a wobble-like effect because the perimeters of the wheels 102, 104, 106, 108 define non-circular rotation. It is noted that the square wheel, triangular and all other embodiments also wobble as they move. Moreover, the perimeters of the non-circular rotational perimeter wheels 102, 104, 106, 108 may be round, oval, or egg-shaped, etc., provided they conform to the definitions above.

In a particular preferred embodiment as shown in FIG. 1, each non-circular wheel 20, 22, 24, 26 on the vehicle may define the same number of segments, such as four segments or four sides, as also shown in FIG. 2 for the first non-circular wheel 20, and each wheel 20, 22, 24, 26 also defines the same angle, such as ninety degrees, between segments of each wheel 20, 22, 24, 26. Because the angle between the segments is the same, the vehicle 10 may readily travel in a forward or rearward direction of travel based upon whether the offset arm 76 is moving in a clockwise or a counter clockwise direction.

Steering apparatus to support the vehicle 10 as it moves along the direction of travel 30 have been discussed in general terms above, and also include all known steering means known in the art, including conventional steering mechanisms, that could be utilized with the firmly attached, non-circular wheels. It is pointed out, that in embodiments of the vehicle having non-circular wheels wherein the angles between segments of the wheels are all the same angle, the vehicle may readily move in a forward direction of travel 80, or in a rearward direction of travel if the rotation of the offset arm is reversed from the clockwise direction to a counter clockwise direction (not shown). Such forward then rearward motion may be part of a steering mechanism, wherein two fixed arcs, or two alternate steering directions are integrated into the relationship between the wheels, so that the vehicle 10 may travel in a forward direction on one arc for a predetermined distance and for a predetermined portion of an arc. Then the vehicle 10 is configured, such as by pivoting of a front end of the vehicle 10 relative to a back end of the vehicle 10. Then the rotation of the off set arm 76 is reversed, and the vehicle then progresses toward a predetermined destination along the second arc.

The driving force described is produced by gravity or a gravitational force, through the use of the weight 84, 84' on the end of offset arm 76, 76' which produces a normal force off-set from the geometric center of the non-circular wheels. The FIGS. 1 and 8 embodiments of the vehicle have limits imposed by the fact that increasing the driving force by increasing the mass of the weight 82, 82' adds to the mass (inertia) of the vehicle 10 which in turn inhibits acceleration. In addition the gravity forces and inertial forces must balance so that the vehicle does not tip over. Other forces that could hold the vehicle against a surface, and provide a moving force means for propelling the non-circular wheels of the vehicle 10, 100 along, are aerodynamic, hydrodynamic, magnetic, electrostatic, electromagnetic, and magneto-hydrodynamic. Such forces could be independent of the vehicle 10, 100 mass, and could thus propel the vehicle 10 with much greater force and velocity. When a non-circular wheel 20, 22, 24, 26, 102, 104, 106, 108 is in collapse alignment as described above, a force applied to the axle 14, 16, 14, 16' or center of rotation of the non-circular wheels that is also normal to the support surface 52, 52' will produce a moment about the center of rotation and will tend to make the non-circular wheels rotate from the collapse alignment 32 to the contact alignment 34. The same effect happens to the square-shaped non-circular wheels 20, 22, 24, 26, of the FIG. 1 embodiment and the non-circular rotational perimeter wheels 102, 104, 106, 108 of the FIG. 8 embodiment. When the applied moving force means is in proximity to a non-circular wheel in collapse alignment, and is of sufficient magnitude to produce a moment tending rotate that wheel, and the moment is greater than the sum of the resisting moments of the remaining wheels, then the wheel will rotate, and the vehicle 10, 100 will move in the direction of travel 30, 30'.

For example, aerodynamic forces can be used to create advantageous forces on a vehicle without greatly increasing the mass (inertia) of the vehicle. "Formula I" race cars use airfoils to push the car down, thus increasing wheel friction and resistance to sliding, without increasing the inertia of the vehicle. This allows them to go around corners much faster than would otherwise be possible. In a similar way, the present vehicle 10, 100 could use aerodynamic forces to provide the off-set normal force to propel the vehicle 10 without increasing the inertia of the vehicle 10. An airfoil (or hydrofoil) could be employed in place of the off-set weight, and linked so that it always faced the flow source. An example of an electromagnetic embodiment could use an electro-magnet located near each wheel, which can pull down towards a steel (ferrous) riding surface. Each electro-magnet could be sequenced so as to provide the moving off-set force to propel the vehicle. Such magnets could be digitally sequenced, activating the next magnet in the sequence as (or just after) the current active magnet is deactivated. Alternatively, the power to the magnets could be smoothly varied so as to produce the effect of a normal force moving smoothly around a circular path, much like the weight. For extremely small versions of the present vehicle 10, 100 a moving magnetic force could be generated by a microelectronic circuit interacting with the vehicle. It seems that electro-magnetic and electro-static forces increase their effectiveness as the size of an object decreases, thus making the potential to propel objects much greater as the size decreases, which is a good case for micro-machines. Electrostatics could be used to create the off-set force using positively and negatively charged components.

While all the aforementioned embodiments 10, 100 use a moving force means that is not connected directly to the axles/wheels to facilitate the movement of the car, there are advantages to the sequential alignment, phase-locked nature of these embodiments in and of itself, such as in alternate embodiments (not shown) where the axles/wheels are directly driven by a motor/transmission of some sort. For example, a standard car with four square wheels would be very difficult to propel because at one time or another all the wheels would be in collapsed alignment at the same time, greatly lowering the center of gravity, and requiring all the wheels to lift the car at the same time. And, the ride would be very rough to say the least. This would not happen with the sequential alignment, phased-locked version, with 4 square wheels sequentially phased by 22.5 degrees for example, because the center of gravity remains much higher, and the wheels are never in collapsed alignment at the same time, consequently the ride is much smoother and the car much easier to propel. It is surprisingly easy to push the four square, non-circular wheel prototypes. This same embodiment with the four spoke wheel defining the corners of a square, non-circular wheel should have advantages over the conventional round wheel version traversing rough terrain. Embodiments with other number of wheels would also have this advantage. Consequently, this invention also includes the described embodiments having sequential alignment, phase-locked non-circular wheels propelled by a force acting upon the wheels in any manner known in the art, such as acting directly upon the wheels or upon the linkage between the wheels.

Research has been done upon actual embodiments 10, 100 and upon computer models of the present invention, and the research results are very encouraging. A mechanical locomotive device was modeled using an "AUTOLEV" brand name computer program. With an "ANIMAKEK" brand name software tool, visualization of the resulting motion was displayed. The model was created with twenty parameters of which six were critical to the design variation process. Each of these six parameters was varied independently so as to understand the relative robustness of the current design. The operating range of these parameters was determined. The working prototype's specific value of these six critical parameters was interestingly found in the middle third of the good operating range, meaning that the working prototype 10 shown in FIG. 1 was built at a near optimal set of dimensions, and that the overall operation of the new theory was quite robust since the operating ranges were in general quite significant in size. The overall engineering assessment is that this novel mechanical locomotive device has a significant future with many application possibilities.

To best understand the operational steps of the vehicle 10, each distinct step of a complete cycle of the offset weight rotation through a weight circumference about all of the wheels 20, 22, 24, 26 was determined. Gait is a term often used to understand the walking sequence of a human, a horse, or even a six legged robotic vehicle. There were nine steps represented within this test, demonstrating one-half of a weighted arm cycle or weight circumference. These steps were performed at quasi-static positions, without any concern about inertia, dynamics, or any sort of active rocking motion. At slow speeds these steps relate to reality, but at higher speeds may be different;

The computer model used was a multi-rigid body model where the wheels, car body, and arm are all treated as individual bodies. The equations were formulated using a well established technique in the multibody systems based on a generalization of Jourdain's Principle which yields the correct system equations of motion in a form which is particularly efficient and suitable for computer simulation. The equations of motion were actually developed with the aid of the software package "AUTOLEV" brand name which is marketed by Online Dynamics, Inc. This is a particularly versatile tool which was chosen for this problem because of its versatility, and the associated visualization software "ANIMAKE" brand name, which in combination made the simulation and visualization of this interesting problem straight forward.

The computer model itself used a generalized velocity projections method, popularly referred to as "Kane's Method". Projection methods such as this are the dominant methods used for the efficient and accurate modeling of large scale, industrial scope problems. The model allows virtually all dimensions, wheel angles, and body masses to be varied easily and there effects investigated. The motor speed which moves the arm at a prescribed rate relative to the car is an infinitely variable user input. The wheel interaction with the ground is through a Hertzian contact model which the user can vary to represent different ground contact surface materials. Computer wheel to ground (tangential component) friction is also included. The friction model which is used is more elaborate than a simple coefficient of friction model, being both a nonlinear function of wheel speed and contact model penetration. This computer model could accommodate the representation of smooth, rough, dry, lubricated, soft or hard surfaces. The model is sufficiently general that it is capable of capturing behaviors such as wheel sliding, impacts, and the potential tumbling or flipping of the vehicle.

Parameter Testing: There are six parameters that have significant impact on the overall performance of the computer model. They are: a. arm height; b. end mass; c. rotational rate of the arm; d. wheelbase length; e. wheel size; f. wheel track width. All of these parameters were varied individually over a range of values that determined the extremes, which were defined by unusable performance. The results of these modeling in the "AUTOLEV" brand name program are given in Table 1 below. The computer working prototype model was used as the nominal case. The results were judged upon visual inspection of the "ANIMAKE" brand name computer display program. A nominal case, an optimized case, as well as several of the more interesting (yet unusable) sets of parameters are summarized in Tables below.

TABLE 1

| Computer-model | The working prototype | Works fine |
|---|---|---|
| Computer-arm-high | Very high arm | Car gets stuck |
| Computer-faster | Faster rotation | Bounces yet goes OK |
| Computer-fastest | Even faster rotation | Car is uncontrollable |
| Computer-large-arm-mass | Heavy weight | Flips over backward |
| Computer-large-wheels | Wheels too large | Not possible |
| Computer-long Wheelbase | Longer car Frame | Gets stuck |
| Computer-narrow wheelbase | Narrow car frame | Rocks side to side |
| Computer | Optimization | Lower Profile and good |

TABLE 2

Initial Parameter Values

| Constant | Value |
|---|---|
| ARM DENSITY | 950 |
| ARM HEIGHT | 0.06 |
| ARMX1 | 0.13335 |
| ARMX2 | 0.01 |
| ARMX3 | 0.03 |
| BASE DENSITY | 950 |
| BASE THICKNESS | 0.01 |
| DNORMAL | 1.00E+05 |

TABLE 2-continued

| Initial Parameter Values | |
|---|---|
| Constant | Value |
| DTANGENTIAL | 4.00E+04 |
| ENDMASS | 0.028 |
| G | 9.81 |
| KDUMMY | 0 |
| KNORMAL | 1.00E+12 |
| ROTATIONRATE | 24 |
| THETA2 | 0.392699 |
| THETA3 | 0.785398 |
| THETA4 | 1.178097 |
| WHEELBASE | 0.1143 |
| WHEEL SIDE DIMENSION | 0.060325 |
| WHEEL THICKNESS | 0.01 |
| WHEEL TRACK | 0.1143 |

TABLE 3

Arm Height Study

| Constant | Value | Value Tested | Comment |
|---|---|---|---|
| ARM DENSITY | 950 | 0.01 | Same as nominal |
| ARM HEIGHT | 0.06 | 0.02 | Same as nominal |
| ARMX1 | 0.13335 | 0.04 | Same as nominal |
| ARMX2 | 0.01 | 0.08 | Same as nominal |
| ARMX3 | 0.03 | 0.1 | A bit more hop per step |
| BASE DENSITY | 950 | 0.15 | Even more hop per step |
| BASE THICKNESS | 0.01 | 0.25 | Almost unstable hop per step |
| DNORMAL | 1.00E+05 | | |
| DTANGENTIAL | 4.00E+04 | | |
| END MASS | 0.028 | | |
| G | 9.81 | | |
| KDUMMY | 0 | | |
| KNORMAL | 1.00E+12 | | |
| ROTATION RATE | 24 | | |
| THETA2 | 0.392699 | | |
| THETA3 | 0.785398 | | |
| THETA4 | 1.178097 | | |
| WHEEL BASE | 0.1143 | | |
| WHEEL SIDE DIMENSION | 0.060325 | | |
| WHEEL THICKNESS | 0.01 | | |
| WHEEL TRACK | 0.1143 | | |

TABLE 4

End Mass Study

| Constant | Value | Value Tested | Comment |
|---|---|---|---|
| ARM DENSITY | 950 | 0 | Wheel motion not even rate |
| ARM HEIGHT | 0.06 | 0.01 | Wheel motion not even rate and wheels bounce |
| ARMX1 | 0.13335 | 0.02 | Wheel motion is even rate and wheels bounce less |
| ARMX2 | 0.01 | 0.05 | Wheel motion is even rate and no wheel bounce but slipping forward |
| ARMX3 | 0.03 | 0.1 | Car bounces/hops sideways and slipping forward |
| BASE DENSITY | 950 | 0.2 | Car flips over backwards due to arm starting position |

TABLE 4-continued

End Mass Study

| Constant | Value | Value Tested | Comment |
|---|---|---|---|
| BASE THICKNESS | 0.01 | | |
| DNORMAL | 1.00E+05 | | |
| DTANGENTIAL | 4.00E+04 | | |
| ENDMASS | 0.028 | | |
| G | 9.81 | | |
| KDUMMY | 0 | | |
| KNORMAL | 1.00E+12 | | |
| ROTATION RATE | 24 | | |
| THETA2 | 0.392699 | | |
| THETA3 | 0.785398 | | |
| THETA4 | 1.178097 | | |
| WHEEL BASE | 0.1143 | | |
| WHEEL SIDE DIMENSION | 0.060325 | | |
| WHEEL THICKNESS | 0.01 | | |
| WHEEL TRACK | 0.1143 | | |

TABLE 5

Rotational Rate Study

| Constant | Value | Value Tested | Comment |
|---|---|---|---|
| ARM DENSITY | 950 | 24 | Base |
| ARM HEIGHT | 0.06 | 1 | No perceived wheel bounce or slip |
| ARMX1 | 0.13335 | 12 | No perceived wheel bounce but some slip |
| ARMX2 | 0.01 | 36 | Wheel bounce and slipping |
| ARMX3 | 0.03 | 48 | Wheel bounce and slipping |
| BASE DENSITY | 950 | 100 | Hops and hesitates |
| BASE THICKNESS | 0.01 | 150 | Erratic and changes direction |
| DNORMAL | 1.00E+05 | | |
| DTANGENTIAL | 4.00E+04 | | |
| ENDMASS | 0.028 | | |
| G | 9.81 | | |
| KDUMMY | 0 | | |
| KNORMAL | 1.00E+12 | | |
| ROTATIONRATE | 24 | | |
| THETA2 | 0.392699 | | |
| THETA3 | 0.785398 | | |
| THETA4 | 1.178097 | | |
| WHEELBASE | 0.1143 | | |
| WHEEL SIDE DIMENSION | 0.060325 | | |
| WHEEL THICKNESS | 0.01 | | |
| WHEEL TRACK | 0.1143 | | |

TABLE 6

Wheelbase Length Study

| Constant | Value | Value Tested | Comment |
|---|---|---|---|
| ARM DENSITY | 950 | 0.05 | Car flips over backwards due to arm starting position |
| ARM HEIGHT | 0.06 | 0.08 | A bit more car bounce than nominal |
| ARMX1 | 0.13335 | 0.14 | Similar to nominal |
| ARMX2 | 0.01 | 0.2 | Wheel rotation rocking/oscillation |
| ARMX3 | 0.03 | 0.3 | Slight forward motion and then gets stuck |

TABLE 6-continued

| Wheelbase Length Study | | | |
|---|---|---|---|
| Constant | Value | Value Tested | Comment |
| BASE DENSITY | 950 | | |
| BASE THICKNESS | 0.01 | | |
| DNORMAL | 1.00E+05 | | |
| DTANGENTIAL | 4.00E+04 | | |
| ENDMASS | 0.028 | | |
| G | 9.81 | | |
| KDUMMY | 0 | | |
| KNORMAL | 1.00E+12 | | |
| ROTATION RATE | 24 | | |
| THETA2 | 0.392699 | | |
| THETA3 | 0.785398 | | |
| THETA4 | 1.178097 | | |
| WHEELBASE | 0.1143 | | |
| WHEEL SIDE DIMENSION | 0.060325 | | |
| WHEEL THICKNESS | 0.01 | | |
| WHEEL TRACK | 0.1143 | | |

TABLE 7

| Wheel Size Study | | | |
|---|---|---|---|
| Constant | Value | Value Tested | Comment |
| ARM DENSITY | 950 | 0.02 | Similar to nominal but little distance covered |
| ARM HEIGHT | 0.06 | 0.04 | Slipping forward and backward |
| ARMX1 | 0.13335 | 0.08 | Wheel rotation is uneven |
| ARMX2 | 0.01 | 0.1 | Wheel rotation is uneven and hit each other |
| ARMX3 | 0.03 | | |
| BASE DENSITY | 950 | | |
| BASE THICKNESS | 0.01 | | |
| DNORMAL | 1.00E+05 | | |
| DTANGENTIAL | 4.00E+04 | | |
| ENDMASS | 0.028 | | |
| G | 9.81 | | |
| KDUMMY | 0 | | |
| KNORMAL | 1.00E+12 | | |
| ROTATION RATE | 24 | | |

TABLE 7-continued

| Wheel Size Study | | | |
|---|---|---|---|
| Constant | Value | Value Tested | Comment |
| THETA2 | 0.392699 | | |
| THETA3 | 0.785398 | | |
| THETA4 | 1.178097 | | |
| WHEEL BASE | 0.1143 | | |
| WHEELSIDE DIMENSION | 0.060325 | | |
| WHEEL THICKNESS | 0.01 | | |
| WHEEL TRACK | 0.1143 | | |

TABLE 8

| Wheel Track Width Study | | | |
|---|---|---|---|
| Constant | Value | Value Tested | Comment |
| ARM DENSITY | 950 | 0.05 | Car flips on side immediately |
| ARM HEIGHT | 0.06 | 0.08 | Car rocks to side for each arm rotation by does not flip |
| ARMX1 | 0.13335 | 0.14 | Similar to nominal |
| ARMX2 | 0.01 | 0.2 | Similar to nominal |
| ARMX3 | 0.03 | 0.3 | Moves one step and is then stuck |
| BASE DENSITY | 950 | | |
| BASE THICKNESS | 0.01 | | |
| DNORMAL | 1.00E+05 | | |
| DTANGENTIAL | 4.00E+04 | | |
| ENDMASS | 0.028 | | |
| G | 9.81 | | |
| KDUMMY | 0 | | |
| KNORMAL | 1.00E+12 | | |
| ROTATIONRATE | 24 | | |
| THETA2 | 0.392699 | | |
| THETA3 | 0.785398 | | |
| THETA4 | 1.178097 | | |
| WHEEL BASE | 0.1143 | | |
| WHEEL SIDE DIMENSION | 0.060325 | | |
| WHEEL THICKNESS | 0.01 | | |
| WHEELTRACK | 0.1143 | | |

TABLE 9

| Combined Optimization Tests | | | | | |
|---|---|---|---|---|---|
| Constant | Value | Test 1 | Test 2 | Test 3 | Test 4 |
| ARM DENSITY | 950 | 950 | 950 | 950 | 950 |
| ARM HEIGHT | 0.06 | 0.02 | 0.02 | 0.02 | 0.02 |
| ARMX1 | 0.13335 | 0.13335 | 0.07 | 0.06 | 0.06 |
| ARMX2 | 0.01 | 0.01 | 0.01 | 0.01 | 0.01 |
| ARMX3 | 0.03 | 0.03 | 0.03 | 0.03 | 0.03 |
| BASE DENSITY | 950 | 950 | 950 | 950 | 950 |
| BASE THICKNESS | 0.01 | 0.01 | 0.01 | 0.01 | 0.01 |
| DNORMAL | 1.00E+05 | 1.00E+05 | 1.00E+05 | 1.00E+05 | 1.00E+05 |
| DTANGENTIAL | 4.00E+04 | 4.00E+04 | 4.00E+04 | 4.00E+04 | 4.00E+04 |
| ENDMASS | 0.028 | 0.02 | 0.02 | 0.05 | 0.06 |
| G | 9.81 | 9.81 | 9.81 | 9.81 | 9.81 |
| KDUMMY | 0 | 0 | 0 | 0 | 0 |
| KNORMAL | 1.00E+12 | 1.00E+12 | 1.00E+12 | 1.00E+12 | 1.00E+12 |
| ROTATION RATE | 24 | 30 | 30 | 30 | 30 |
| THETA2 | 0.392699 | 0.392699 | 0.392699 | 0.392699 | 0.392699 |
| THETA3 | 0.785398 | 0.785398 | 0.785398 | 0.785398 | 0.785398 |
| THETA4 | 1.178097 | 1.178097 | 1.178097 | 1.178097 | 1.178097 |
| WHEELBASE | 0.1143 | 0.1143 | 0.1143 | 0.1143 | 0.1143 |

TABLE 9-continued

| Combined Optimization Tests | | | | | |
|---|---|---|---|---|---|
| Constant | Value | Test 1 | Test 2 | Test 3 | Test 4 |
| WHEEL SIDE DIMENSION | 0.060325 | 0.07 | 0.07 | 0.07 | 0.07 |
| WHEEL THICKNESS | 0.01 | 0.01 | 0.01 | 0.01 | 0.01 |
| WHEEL TRACK | 0.1143 | 0.1143 | 0.1143 | 0.1143 | 0.1143 |
| Comments | | OK but uneven wheel rotation | Limited motion and stalled | Uneven wheel motion but nice compact form Best so far | More wheel bounce |

CONCLUSIONS

There is a broad working range for each of the six parameters tested. This speaks highly about the robustness of the overall invention. There is great robustness in the concept and there is no parameter on the knife edge ready to be a major issue if any parameter varies slightly. This overall robustness is highly desired. The working prototype of FIG. 1 had its six parameters in the middle third of the each of the operating ranges. The lower profile and optimized version seen in the computer model may be closer to implementation in the MEMS world, which is also very good.

While the present invention 10, 100 has been disclosed with respect to the described and illustrated embodiments, it is to be understood that the invention is not to be limited to those embodiments. Accordingly, reference should be made primarily to the following claims rather than the foregoing description to determine the scope of the invention.

What is claimed is:

1. A vehicle having non-circular wheels propelled by a moving force, the vehicle (10) comprising:

a. a frame (12) having a first non-circular wheel (20) a second non-circular wheel (22) and at least a third non-circular wheel (24) secured to the frame (12), each non-circular wheel (20, 22, 24) including a perimeter having at least two contact segments (29, 50) for contacting a support surface (52) under and supporting the vehicle (10);

b. linkage means (18) secured to the non-circular wheels (20, 22, 24) for rotating all non-circular wheels (20, 22, 24) upon the rotation of one of the non-circular wheels (20, 22, 24);

c. the non-circular wheels (20, 22, 24) secured to the frame (12) in a sequential alignment so that whenever a first contact segment (50) of the first non-circular wheel (20) is secured to the frame (12) in a contact alignment (46) to contact the support surface (52) below the vehicle (10), a first contact segment (29) of the second non-circular wheel (22) is secured to the frame (12) in a collapse alignment (44) whereby motion of the vehicle (10) in a direction of travel (30) moves the second non-circular wheel (22) from the collapse alignment (44) to the contact alignment (46), and so that whenever the first contact segment (29) of the second non-circular wheel (22) is in the collapse alignment (44), a first contact segment of the third non-circular wheel (24) is secured to the frame (12) in a non-contact, non-collapse alignment (48); and, d. moving force means for propelling the non-circular wheels (20, 22, 24) to sequentially move from collapse alignment (32) to contact alignment (34) to move the vehicle (10) in the direction of travel (30).

2. The vehicle (10) of claim 1, wherein the moving force means for propelling the non-circular wheels (20, 22, 24) comprises:

a. an offset arm (76) movably secured to motor (78) means secured to the frame (12) for moving the offset arm (76), the offset Arm (76) including a weight support end (82) and an opposed motor attachment end (80), wherein the motor attachment end (80) is movably secured to the motor (78) means and the offset arm (76) is configured so that movement of the motor attachment end (80) by the motor (78) means moves the weight support end (82) about a weight circumference defined by movement of the weight support end (82), the weight circumference being defined around an approximate geometric center between the non-circular wheels (20, 22, 24); and, b. a weight (84) supported by the weight support end (82) of the offset arm (76), the weight (84) configured to be sufficiently heavy and the weight support end (82) of the offset arm (76) being configured to be a sufficient distance from the geometric center between the wheels (20, 22, 24) so that as the motor means (78) moves the weight support end (82) of the arm (76) about the weight circumference through the sequential alignment over the non-circular wheels (20, 22, 24), gravity forces a non-circular wheel (20, 22, 24) in the collapse alignment (32) under the weight (84) to collapse to the contact alignment (34), and the linkage means (18) moves the next sequential non-circular wheel (20, 22, 24) to the collapse alignment (32) to be collapsed to the contact alignment (34) as the weight (84) moves through the weight circumference to thereby move the vehicle (10) in the direction of travel (30).

3. The vehicle (10) of claim 1, wherein the linkage means (18) comprises a mechanical connection extending between a first axle (14) and a second axle (16) for rotating the first axle (14) upon rotation of the second axle (16) and for rotation of the second axle (16) upon rotation of the first axle (14), the non-circular wheels (20, 22, 24) being secured to the axles (14, 16).

4. The vehicle (10) of claim 1, wherein each non-circular wheel (20, 22, 24) on the vehicle (10) defines an equal number of segments, and each wheel (20, 22, 24) also defines an equal angle between segments of each wheel (20, 22, 24).

5. The vehicle (10) of claim 1, wherein at least one of the non-circular wheels (20, 22, 24) comprises a plurality of spokes (91A, 91B, 91C) defining voids between the spokes.

6. The vehicle (10) of claim 1, wherein the moving force is selected from the group consisting of gravitational force, aerodynamic force, hydrodynamic force, electromagnetic force, magnetic force, electrostatic force, magnetic force, inertial force, and magneto-hydrodynamic force.

7. The vehicle (10) of claim 1, wherein at least one of the non-circular wheels (20, 22, 24) is an ellipse.

8. The vehicle (10) of claim 1, wherein at least one of the non-circular wheels (20, 22, 24) is bi-convex.

9. A vehicle having non-circular rotational perimeter wheels propelled by a moving force, the vehicle (100) comprising:

a. a frame (12') having a first non-circular rotational perimeter wheel (102) a second non-circular rotational perimeter wheel (104) and at least a third non-circular rotational perimeter wheel (106) eccentrically secured to the frame (12'), each non-circular rotational perimeter wheel (102, 104, 106) including a perimeter having at least two contact segments (110, 112) for contacting a support surface (52') under and supporting the vehicle (100);

b. linkage means (18') secured to the non-circular rotational perimeter wheels (102, 104, 106) for rotating all non-circular rotational perimeter wheels (102, 104, 106) upon the rotation of one of the wheels (102, 104, 106);

c. the non-circular rotational perimeter wheels (102, 104, 106) secured to the frame (12') in a sequential alignment so that whenever a first contact segment (110) of the first non-circular wheel (102) is secured to the frame (12') in a contact alignment to contact the support surface (52') below the vehicle (100), a first contact segment of the second non-circular wheel (104) is secured to the frame (12') in a collapse alignment whereby motion of the vehicle (100) in a direction of travel (30') will move the second non-circular wheel (104) from the collapse alignment to the contact alignment, and so that whenever the first contact segment of the second non-circular wheel (104) is in the collapse alignment, a first contact segment of the third non-circular wheel (106) is secured to the frame (12') in a non-contact, non-collapse alignment; and, d. moving force means for propelling the non-circular rotational perimeter wheels (102, 104, 106) to sequentially move from collapse to contact alignment to move the vehicle (100) in the direction of travel (30').

10. The vehicle having non-circular rotational perimeter wheels (100) of claim 9, wherein the moving force means for propelling the rotational perimeter wheels (102, 104, 106) comprises:

a. an offset arm (76') movably secured to motor (78') means secured to the frame (12') for moving the offset arm (76'), the offset arm (76') including a weight support end (82') and an opposed motor attachment end (80'), wherein the motor attachment end (80') is movably secured to the motor means (78') and the offset arm (76') is configured so that movement of the motor attachment end (80') by the motor (78') means moves the weight support end (82') about a weight circumference defined by movement of the weight support end (82'), the weight circumference being defined around an approximate geometric center between the non-circular rotational perimeter wheels (102, 104, 106); and, b. a weight (84') supported by the weight support end (82') of the offset arm (76'), the weight (84') configured to be sufficiently heavy and the weight support end (82') of the offset arm (76') being configured to be a sufficient distance from the approximate geometric center between the wheels (102, 104, 106) so that as the motor means (78') moves the weight support end (82') of the arm (76') about the weight circumference through the sequential alignment over the non-circular rotational perimeter wheels (102, 104, 106), gravity forces a wheel (102, 104, 106) in the collapse alignment under the weight (84') to collapse to the contact alignment, and the linkage means (18') moves the next sequential wheel (102, 104, 106) to the collapse alignment to be collapsed to the contact alignment as the weight (84') moves through the weight circumference to thereby move the vehicle (100) in the direction of travel (30').

11. The vehicle having non-circular rotational perimeter wheels (100) of claim 9, wherein the linkage means (18') comprises a mechanical connection extending between a first axle (14') and a second axle (16') for rotating the first axle (14') upon rotation of the second axle (16') and for rotation of the second axle (16') upon rotation of the first axle (14'), the non-circular rotational wheels (102, 104, 106) being secured to the axles (14', 16').

12. The vehicle having non-circular rotational perimeter wheels (100) of claim 9 wherein the moving force is selected from the group consisting of gravitational force, aerodynamic force, hydrodynamic force, electromagnetic force, magnetic force, electrostatic force, magnetic force, inertial force, and magneto-hydrodynamic force.

13. A method of propelling a vehicle (10), comprising the steps of:

a. securing three or more non-circular wheels (20, 22, 24, 102, 104, 106) to a frame (12, 12') of the vehicle in a sequential alignment so that whenever a first contact segment (50) of the first non-circular wheel (20) is secured to the frame (12) in a contact alignment (46) to contact the support surface (52) supporting the vehicle (10), a first contact segment (29) of the second non-circular wheel (22) is secured to the frame (12) in a collapse alignment (44) whereby motion of the vehicle (10) in a direction of travel (30) moves the second non-circular wheel (22) from the collapse alignment (44) to the contact alignment (46), and so that whenever the first contact segment (29) of the second non-circular wheel (22) is in the collapse alignment (44), a first contact segment of the third non-circular wheel (24) is secured to the frame (12) in a non-contact, non-collapse alignment (48); and, b. linking the non-circular wheels (20, 22, 24) together for rotating all non-circular wheels (20, 22, 24) upon the rotation of one of the non-circular wheels (20, 22, 24); and, c. applying a moving force to the non-circular wheels (20, 22, 24) to sequentially move from collapse (32) to contact alignment (34) to move the vehicle (10) in the direction of travel (30).

14. The method of propelling a vehicle (10) of claim 13, wherein the step of applying a moving force to the non-circular wheels (20, 22, 24) comprises rotating a weight (84) secured to an offset arm (76) about an approximate geometric center between the non-circular wheels (20, 22, 24), the weight (84) configured to be sufficiently heavy and the offset arm (76) being configured to be a sufficient distance from the geometric center between the wheels (20, 22, 24) so that as the weight rotates over the non-circular wheels (20, 22, 24), gravity forces a non-circular wheel (20, 22, 24) in the collapse alignment (32) under the weight (84) to collapse to the contact alignment (34), thereby rotating the linked non-circular wheels (20, 22, 24) to a next sequential alignment (22).

* * * * *